US005991417A

United States Patent [19]

Topholm

[11] Patent Number: 5,991,417

[45] Date of Patent: Nov. 23, 1999

[54] PROCESS FOR CONTROLLING A PROGRAMMABLE OR PROGRAM-CONTROLLED HEARING AID FOR ITS IN-SITU FITTING ADJUSTMENT

[75] Inventor: Jan Topholm, Holte, Denmark

[73] Assignee: Topholm & Westerman ApS, Vaerloese, Denmark

[21] Appl. No.: 08/945,508

[22] PCT Filed: May 2, 1995

[86] PCT No.: PCT/EP95/01649

§ 371 Date: Oct. 29, 1997

§ 102(e) Date: Oct. 29, 1997

[87] PCT Pub. No.: WO96/35314

PCT Pub. Date: Nov. 7, 1996

[51] Int. Cl.[6] ..... H04R 29/00

[52] U.S. Cl. ..... 381/60; 381/321; 381/318

[58] Field of Search ..... 381/109, 107, 381/60, 318, 317, 321, 320, 57, 56, 58; 73/585

[56] References Cited

U.S. PATENT DOCUMENTS 4,185,168 1/1980 Graupe et al. .
4,972,487 11/1990 Mangold et al. ..... 381/60
5,016,280 5/1991 Engebretson et al. .
5,027,410 6/1991 Williamson et al. .
5,130,665 7/1992 Walden ..... 381/109
5,225,836 7/1993 Morley, Jr. et al. .

*Primary Examiner*—Vivian Chang
*Attorney, Agent, or Firm*—Sughrue, Mion, Zinn, Macpeak & Seas, PLLC

[57] ABSTRACT

The process for controlling a programmable or program-controllable hearing aid for in-situ adjustment of said hearing aid to an optimum target gain in one or more frequency bands by establishing the hearing threshold level of the wearer for one or more frequency bands, determining the target input/output response for the detected hearing loss and generating a corresponding parameter set for an ideal input/output response for the detected hearing loss under feedback-free conditions, by setting the control parameter set of a signal processor initially to an input/output response with a gain equal to the maximum target gain, operating the hearing aid in-situ in accordance with said initial input/output response while monitoring said hearing aid for the occurence of any acoustic feedback, and if no noticeable feedback is detected setting said initial parameter set for said input/output response into said hearing aid, and if noticeable acoustic feedback is detected reducing the gain over at least one of said frequency bands while leaving unchanged with respect to said initial parameter set the gain in any other frequency band, to thereby obtain an adjusted input/output response for at least said one frequency band.

11 Claims, 4 Drawing Sheets

PROCESS FOR CONTROLLING A PROGRAMMABLE OR PROGRAM-CONTROLLED HEARING AID FOR ITS IN-SITU FITTING ADJUSTMENT

BACKGROUND OF THE INVENTION

The invention relates to a process for controlling a programmable or program-controllable hearing aid for in-situ adjustment of said hearing aid to the optimum gain in one or more frequency bands, with due consideration of any possible acoustical feedback, as per the preamble of claim 1.

It is well known that with hearing instruments, be it with BTE hearing aids that are connected to the ear canal by means of a small-diameter plastic tubing and an earmold, or with an ITE hearing aid inserted deeply into the ear canal with its earmold or otoplastic, acoustic feedback is possible from the residual cavity between the earmold and the timpanic membrane to the microphone, either by a less than perfect fit of the earmold in the ear canal or by a small venting tubing provided for pressure relief, or both.

This has for example been described in "HEARING INSTRUMENTS, Vol. 42, Nr. 9 1991, pages 24, 26".

Additionally, U.S. Pat. No. 5,259,033 and its European counterpart EP 0 415 677 A2 disclose a hearing aid with an electric or electronic compensation for acoustic feedback. Particularly, the hearing aid includes a controllable filter in an electrical feedback path, the characteristics of which are calculated and controlled to model the acoustic coupling between the earphone and the microphone of the hearing aid using a correlation method.

A noise signal is injected into the electrical circuit of the hearing aid and is used for adapting the filter characteristics to accommodate changes in the acoustic coupling.

The coefficients for controlling the filter characteristics are derived by a correlation circuit.

Furthermore the WO 93/20668, published with abstract and claims in english and drawings only discloses in principle the same circuitry, further including a digital circuit which carries out a statistical evaluation of the filter coefficients in a correlation circuit and changes the feedback function adaptively. The compensation covers the entire audible frequency range.

WO-A-9005437 and U.S. Pat. No. 4,185,168 are both further examples of automatic systems for reducing feedback problems, when they occur during normal operation. For this purpose simply additional complex circuitry is used in the hearing aid and additional filters are required, which will effect the entire frequency band where and when they are activated.

Many of the more modern hearing aids are capable of varying the gain in order to adjust to the actual sound environment and the actual hearing loss. This can be done in one or more frequency bands.

Most hearing losses are characterized by "recruitment". In other words, weak sounds cannot be detected and powerful sounds are heard as normal hearing people would hear them. Traditionally, these hearing losses are fitted with hearing aids having a fixed gain. This gain is typically too low at weak sound levels and too high at powerful sound levels.

To compensate more ideally for this kind of hearing loss the hearing aid should have high gain at weak sounds and zero or low gain at powerful sounds. Such types of hearing aids typically have high gain in quiet environments which increases the risk of acoustic feedback. The gain at which feedback occurs depends primarily on the quality and shape of the earmold.

However, until now the most common way to solve the problem of an unsatisfactory earmold that caused unacceptable acoustic feedback was to throw it away and have a new one made. This means that no one ever knew what was wrong with it and exactly how bad the earmold was.

Obviously poor earmolds cause considerable problems in case of severe hearing losses and the then necessary high gains. In order to avoid feedback with an earmold that cannot be made better the hard-of-hearing has the only choice to turn down the volume control for the entire frequency range.

Generally, there are more and more programmable, program-controllable or programmed hearing aids most of which could be reprogrammed for one or more frequency bands or channels by an external programming unit for one or more transmission characteristics and, mostly, adapted at the same time to the actual hearing loss of the wearer.

Unfortunately, when in-situ programming and fitting of a hearing aid of this type, there are presently no instruments to detect any acoustic feedback combined with an automatic testing process to adjust the hearing aid to an insertion gain that avoids acoustical feedback and/or indicates whether for the amplification/gain required for a specific hearing loss the earmold is fitting well enough in the ear canal. This would have the result that at this maximum gain for the specific hearing threshold level no acoustic feedback would occur, indicating whether this earmold has the required quality of fitting inside the ear canal for the specific gain required.

SUMMARY OF THE INVENTION

Generally speaking it is a main object of the present invention to create a novel process with the intention to provide a solution for automatic measuring of the hearing threshold level (HTL) in one or more frequency bands for a specific hearing instrument including the earmold and to provide for an automatic adjustment of the hearing instrument to avoid possible acoustic feedback at the required or possible maximum gain, and finally to provide for the optimization of the parameter set for said final fitting with due consideration of the acoustical feedback and the hearing impairment or the hearing loss of the wearer.

Also last, but not least to provide for automatic checking for the required quality of the earmold and to give a warning in case the quality of the earmold is insufficient to sustain the required gain of the hearing aid for the particular impairment, without feedback to occur.

These objects are achieved by the new process in accordance with the present invention by setting the control parameter set of the signal processor initially to an input/output response function with a maximum gain equal to the maximum gain of the ideal input/output response function and operating the hearing aid in-situ in accordance with said initial ideal input/output response function while monitoring said hearing aid for the occurance of any acoustic feedback, and if no noticeable feedback is detected setting said initial parameter set for said ideal input/output response function into said hearing aid, and if noticeable acoustic feedback is detected reducing the maximum gain over at least one of said frequency bands while leaving unchanged with respect to said initial parameter set the gain in any other frequency band, to thereby obtain an adjusted input/output response function for at least said one frequency band.

A particular improvement of the invention consists in that by the continued or periodic monitoring of the hearing aid for continued feedback, by the control and comunication unit in combination with the programming unit, and by adjusting the maximum gain to a value smaller than the calculated maximum gain and by monitoring again for any remaining feedback and reducing the maximum gain until no further feedback is detected, it is possible to set the actual maximum gain to a value that is equal to the maximum gain that is possible without feedback, and to store the corresponding parameter set in the hearing aid as a final setting.

Furthermore, it is of great advantage that, if the control and communication unit continues to detect feedback after reaching a predefined lowest level of amplification or gain in one or more frequency bands, the fitting process is terminated by storing the results in the programming unit as an indication of the poor quality of the earmold.

Finally, it is important that by simultaneous checking of the prevalent background noise level, it is ascertained that the background noise level is well below the level where the maximum gain appears in order to stop the process in case the background level approaches or exceeds the volume indicated in one or more frequency bands.

BRIEF DESCRIPTION OF THE DRAWING

The invention will now be described with respect to a preferred embodiment of the inventive process and in conjunction with the accompanying drawings.

In the drawings

DETAILED DESCRIPTION OF THE INVENTION

Figure 1:
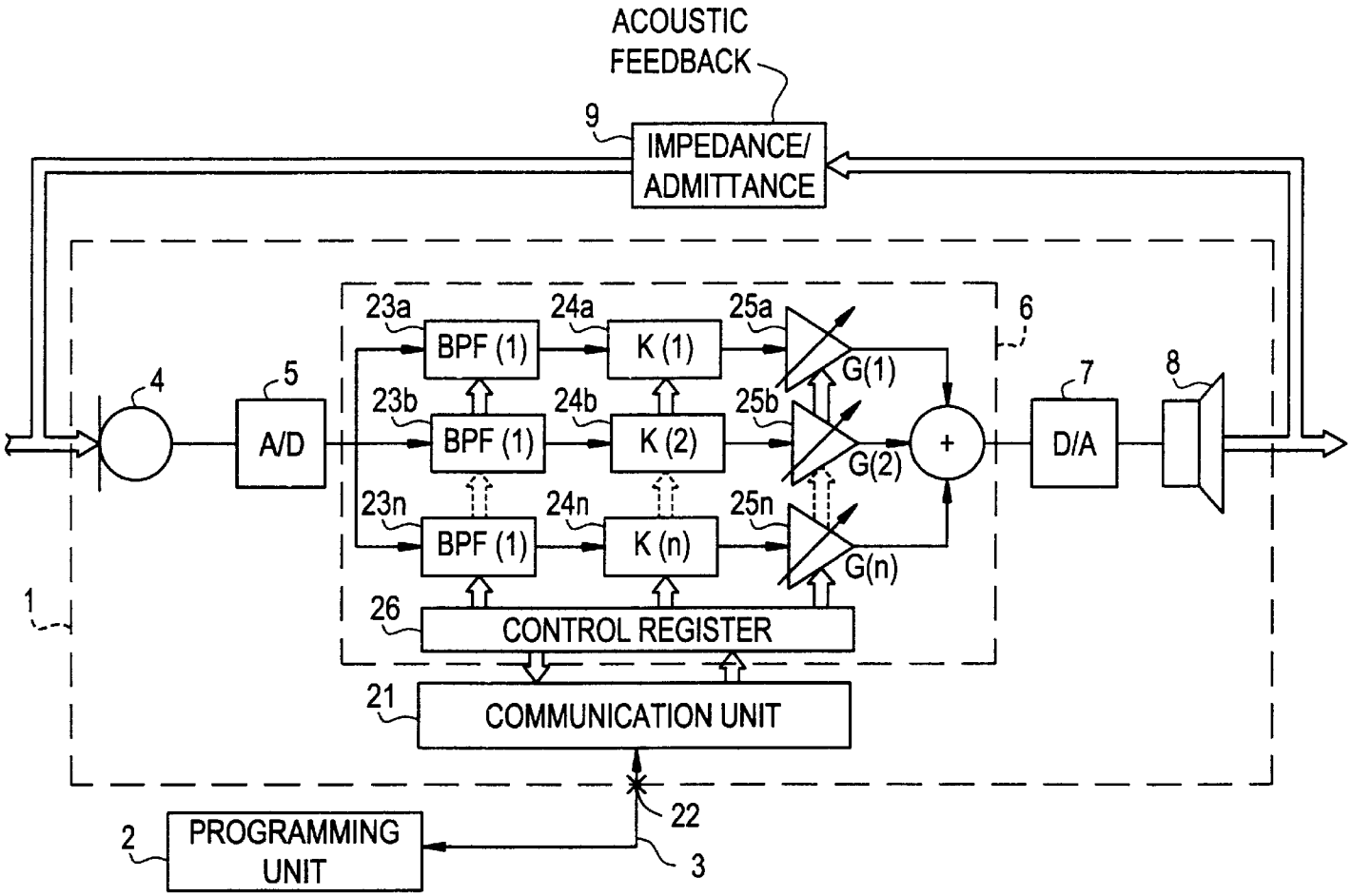
FIG. 1 shows schematically a hearing instrument including programming means.

In FIG. 1, a hearing instrument or wearable hearing aid 1 is shown and is connected to a programming unit 2 by means of a two-way communication link 3. The hearing aid 1 comprises f.i. a microphone 4, an A/D-converter 5, a digital signal processor 6, a D/A-converter 7 and a speaker 8.

Principally, there could be more than one microphone 4 and/or more than one speaker 8.

The signal processor 6 in its digital configuration could, f.i. consist of one channel or a number of channels, for one frequency range or for a number of frequency bands respectively.

Obviously, the entire hearing aid could also contain correspondingly designed analog circuits.

Whether the hearing aid is an ITE instrument to be inserted into the ear canal or a BTE instrument to be connected by means of a sound-conducting tubing with an earmold inserted into the ear canal, there is always the possibility of acoustical feedback. This feedback path is shown as an impedance/admittance 9.

It has to be remarked here that such feedback in some cases of severe hearing loss would be rather difficult to control or to avoid.

FIGS. 2 to 6 will now be used to explain the approach taken for solving the problem as indicated above, namely to provide a simple process to measure the quality of an earmold during the automatic fitting process and to design a process to adjust the hearing aid with the actual limitations of the earmold. In other words, the invention provides a novel method to determine if the actual earmold has a sufficiently high quality of fitting inside the ear canal to match the actual hearing loss in one or more frequency bands.

Figure 2:
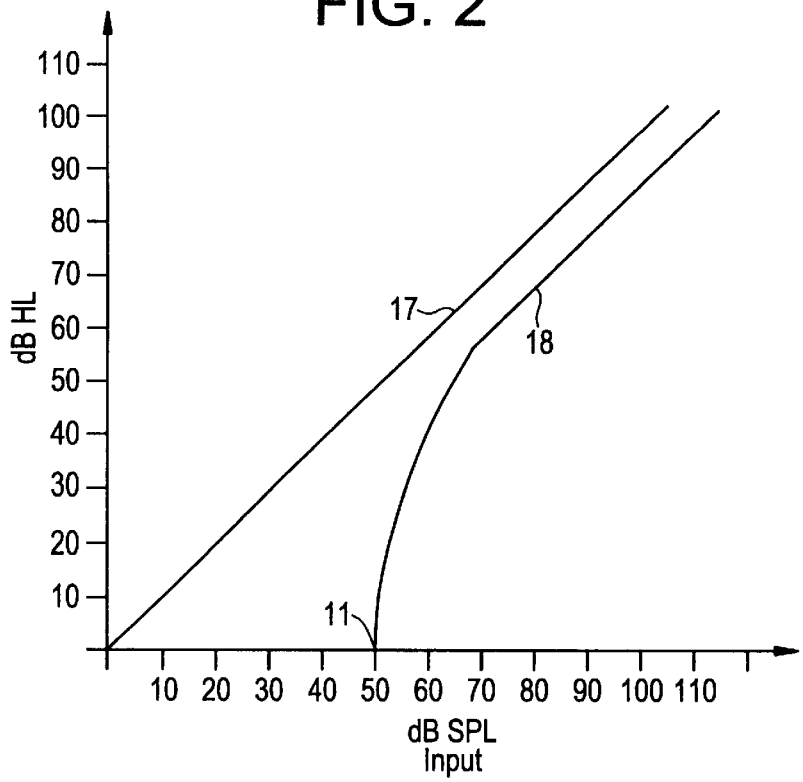
FIG. 2 schematically a diagram of the hearing perception function and the impaired hearing function of the recruitment type.

FIG. 2 shows the normal hearing perception function 17 as the hearing level HL over the sound pressure level SPL and a typical impaired hearing function 18 of the recruitment type, starting at the hearing threshold 11. The curve 18 is the so called loudness contour.

Below the hearing threshold (HTL) 11 nothing can be heard by the hearing impaired, and above the threshold 11 a very rapid rise in the sensitivity occurs. Above a certain level of the SPL the auditory function is almost normal except for a possible conductive component.

Figure 3:
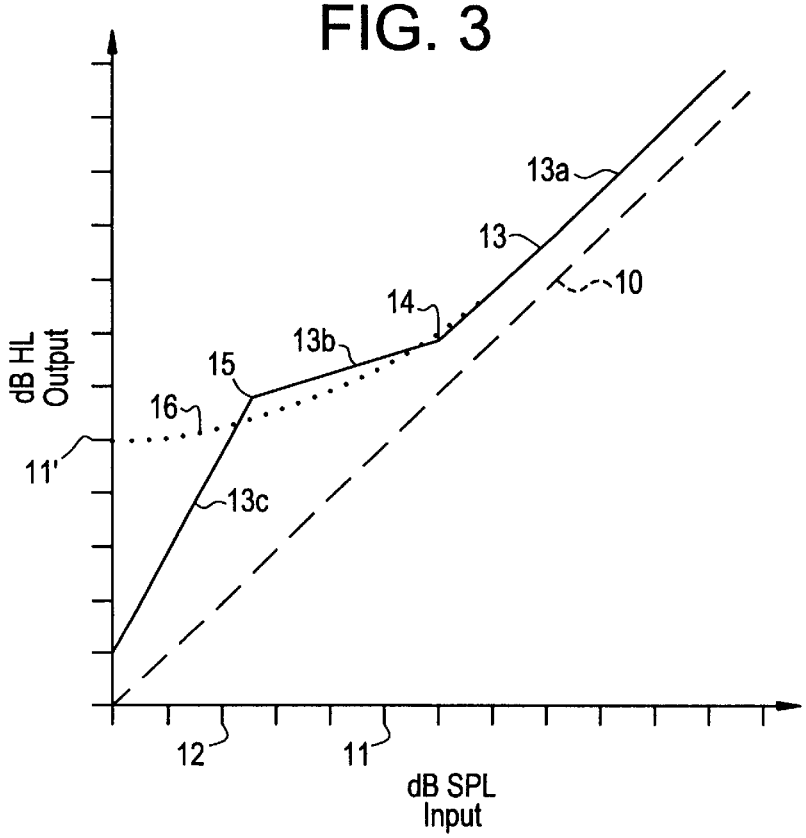
FIG. 3 schematically an ideal input/output response of a hearing aid of the type used for the invention.
Figure 4:
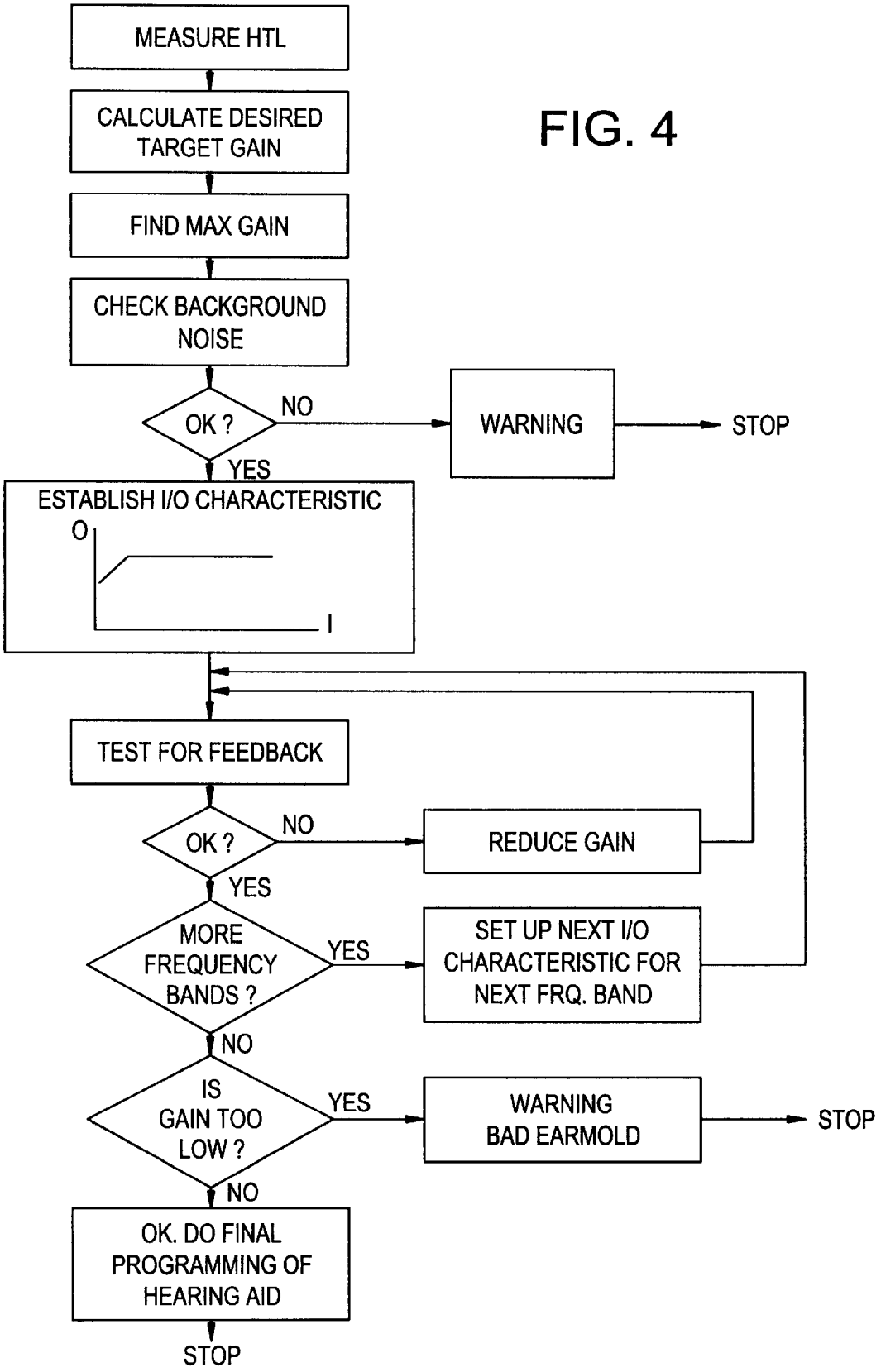
FIG. 4 schematically a flow diagram of the process in accordance with the invention.

The obvious solution to this problem would be to create a hearing aid with an input/output characteristic which is the mirror-image of the recruitment type characteristic shown in FIG. 2. This is shown in FIG. 3, where the mirror-image of the recruitment characteristic starts at point 11' and would follow the dashed line 16. However, this would require an extreme gain at the hearing threshold level, which obviously is impossible due to acoustical feedback caused by the leakage of sound through and around the earmold.

Therefore, a different solution is envisaged in which the hearing aid would have a limited maximum gain which occurs at very low sound levels. FIG. 3 thus shows a theoretical ideal input/output response function 16 for the hearing loss of FIG. 2 and also a typical ideal response function 13 of a hearing aid of the type considered here.

Above the upper kneepoint 14 corresponding to high input levels, a constant low amplification level (gain) 13*a* is present, where the gain is represented in FIG. 3 by the distance between response curve 13 and the normal hearing perception function 10. Below the upper kneepoint 14 and above a lower kneepoint 15, a compression range 13*b* is presented where the gain decreases from the lower kneepoint 15 to the upper kneepoint 14. Below the lower kneepoint 15 corresponding to very low input level, an expansion range 13*c* is present in order to prevent the internal microphone noise from becoming audible. Both kneepoints and the compression or expansion factors for each channel, and the high input gain can be programmed in the hearing aid as a set of parameters, equally for one or more frequency bands.

For a more detailed explanation of the operation and the control function of the hearing aid shown in FIG. 1 a control and communication unit 21 is provided which at a coupling point 22 is detachably connected to the programming unit 2 by the two-way communication link 3. The three channels of the digital signal processor 6 comprise band pass filters 23*a*, 23*b* and 23*c*, limiter stages 24*a*, 24*b* and 24*c* and controllable amplifier stages 25*a*, 25*b* and 25*c*. Of course, these three channels are shown here as an example only and the invention is not limited to these three channels.

The digital signal processor 6 with its components 23, 24 and 25 may at one hand be controlled by the control and communication unit 21 by means of the control register 26. On the other hand the present status of the various components of the digital signal processor 6 is also represented in the control register 26 and its information may also be transferred to the communication and control unit 21 and the programming unit 2.

Figure 5:
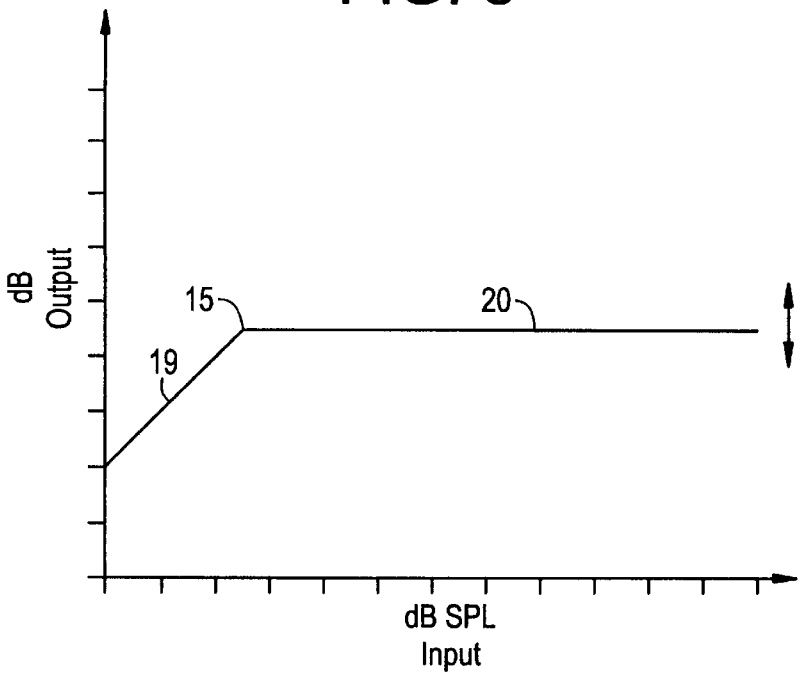
FIG. 5 schematically an illustration of the input/output response used during the test procedure and FIG. 6 shows schematically the resulting input/output response after the test procedure is completed.

During the feedback test procedure an input/output response is used, which is shown in FIG. 5 indicating the relationship between the values of SPL in dB and the output level in dB.

Only the lower kneepoint 15 is used here and the input/output response has a constant gain range 19 below the lower kneepoint 15 and a constant output range 20 beyond the lower kneepoint 15.

After establishing the maximum gain possible it is most important to check the background noise which should be rather low indeed. This is valid of course for each and every frequency band.

The background noise is checked and supervised by the programming unit 2 and the control and communication unit 21 via the microphone 4 and the signal processor 6. In case the background noise is unacceptably high, i.e. approaching or surpassing a predefined low level, a decision circuit responds and issues a warning, whereafter the operation is arrested.

However, if the background noise is acceptably low the control unit establishes the input/output response for the test procedure as shown in FIG. 5.

Will this input/output response as shown in FIG. 5, the control program, by means of the control and communication unit checks for any possibly acoustic feedback that obviously will manifest itself by means of the microphone 4 and the digital signal processor 6. It has to be borne in mind that in case of more than one channel this check has to be carried out for each channel separately.

When checking for feedback in one channel the gain for all other channels has to be set to, e g., Zero.

In case no feedback is detected in any one frequency band the input/output characteristic as shown in FIG. 3 is set up by the program control and the same process is carried out for the next frequency band in the manner as recited above.

However, if any feedback is detected in the channel under test the program control receives this information from units 6, 26 and 21, and reduces under program control the maximum gain up to the lower kneepoint 15 for a continued test for any possible feedback as monitored by the program control.

In case no further feedback is detected the program control checks whether the reduced maximum gain is possibly too low considering the gain required for the particular hearing impairment, the hearing aid and the corresponding earmold. In that case the program control gives a warning that the quality of the earmold is insufficient for the intended use.

For example, this may be an indication that the earmold is not well matched to the earcanal and that the sound from the speaker 8 is leaking around the earmold to arrive at the microphone 4.

Figure 6:
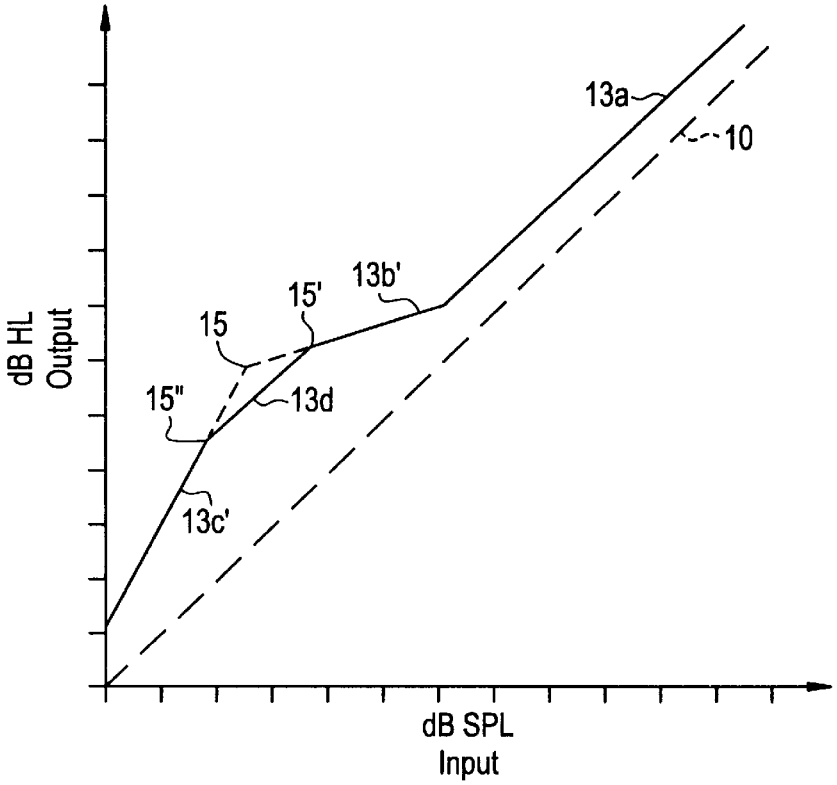

On the other hand, if the finally calculated gain is adequate for the intended use the program establishes the final input/output response function as shown in FIG. 6. The result of the process is the reduced gain range 13*d* due to the clipping of the maximum gain. This implies that the lower kneepoint 15 has been split up into two new kneepoints 15' and 15".

This input/output response function will be represented by a corresponding set of control parameters or control values which will be stored in the hearing aid in its memory in order to control the transfer characteristic of said hearing instrument.

It is also well understood that these parameter sets may also be modified to accommodate various different environmental listenint situations.

The new fitting process provides for a number of possibilities for the in-situ fitting of a programmable or program-controlled hearing aid.

The new process provides for an automatic ability to detect the occurrence of acoustic feedback in one or more frequency bands of a hearing instrument. Thus, information can be read out from the digital signal processor of the hearing aid by means of the control register 26 and into the programming control device connected at least temporarily to the hearing aid. The programming device after receiving this information may then establish or calculate the maximum gain at which the hearing aid will no longer exhibit an acoustical feedback. Of course, the results of such automatic tests could be stored in the programming device for future reference. In case the feedback is still present, even at very much reduced gain levels, this may be an indication that the quality of the ear mold is insufficient to sustain an adequate gain for the established hearing threshold level of the hearing impaired. Thereafter a new earmold would have to be designed and tested again.

It will be understood that the operation of the hearing aid with the input/output response shown in FIG. 5 is testing the maximum gain portion of the initial input/output response, and this is one manner of achieving the end goal of the invention, i.e., to identify the frequency band and sound pressure level at which acoustic feedback occurs. This could be accomplished in other ways, e.g., by operating the hearing aid in-situ with its entire initial input/output response intact, varying the input sound (e.g., varying the level and/or the frequency of the input sound), monitoring the output sound to see when an unstable operation (feedback) occurs, and adjusting the parameter set to decrease the gain at the frequency and sound pressure level where feedback is detected.

Finally, it will be equally understood that the control and communication unit 21 and the control register may also be part of microprocessor circuitry which also may comprise the required storage/memory facilities for storing control function/algorithms for performing the operations in accordance with the present invention and also communicating with the programming unit 2.

I claim:

1. A process for controlling a programmable or program controllable hearing aid (1) comprising a microphone (4) a controllable signal processor (6) for operating on one or more frequency bands, and a speaker (8) for in-situ fitting adjustment of said hearing aid to an optimum gain function in one or more frequency bands, by establishing the hearing threshold level (HTL) of the wearer for one or more frequency bands determining a target input/output response function for the detected hearing loss and generating a corresponding parameter set for an ideal input/output response function (13) for the detected hearing loss under feedback-free conditions, characterized by A setting the control parameter set of tile signal processor (6) initially to an input/output response function (13; 19, 20) with a maximum gain equal to the maximum gain (15) of the ideal input/output response function (13) having high gain at weak sounds and zero or low gain at powerful sounds and B operating the hearing aid in-situ in accordance with said initial input/output response function while monitoring said hearing aid for the occurrence of any acoustic feedback, and C if no noticeable feedback is detected setting said initial parameter set for said input/output response function into said hearing aid, and D if noticeable acoustic feedback is detected reducing the maximum gain (15, 15', 15") over at least one of said frequency bands while leaving unchanged with respect to said initial parameter set the gain in any other frequency band, to thereby obtain an adjusted input/output response for at least said one frequency band.

2. A process according to claim 1, further comprising repeating steps B–D until no noticeable acoustic feedback is detected and thereafter storing the parameter set of the last obtained version of said input/output response into said hearing aid as said optimum input/output response.

3. A process according to claim 1 wherein said monitoring and gain reducing steps are performed separately for each of plural frequency bands.

4. A process according to claim 1, wherein said initial input/output response provides a predetermined gain for input sounds at a predetermined input sound level, and wherein said steps of operating said hearing-aid in accordance with said initial input/output response comprises operating said hearing aid in accordance with said hearing aid set to a test input/output response exhibiting said predetermined gain at said predetermined input sound level.

5. A process according to claim 4, where said test input/output response provides a constant output level for input sounds above said predetermined input sound level.

6. A process according to claim 4, where said test input/output response provides a constant gain for input sounds below said predetermined input sound level.

7. A process according to claim 2, further comprising the step of:

E if after step D the gain is below a predetermined minimum level, terminating said process and storing an indicator of the results of said process as an indication of the quality of said earmold.

8. A process according to claim 1, further comprising the step of:

F prior to step B, monitoring an ambient noise level, and terminating said process if said ambient noise level exceeds a predetermined level.

9. A process according to claim 8, wherein step F is performed for each of plural frequency bands, and the process is terminated if the ambient noise in any of said plural frequency bands exceeds a respective predetermined level.

10. A process according to claim 1, wherein said step of reducing the maximum gain comprises reducing the gain at a sound pressure levels where said maximum gain occurs while leaving unchanged the gain of said response function at at least some other sound pressure levels.

11. A process according to claim 10, wherein said step of reducing the maximum gain comprises reducing the gain over a range of sound pressure levels where said maximum gain occurs while leaving unchanged the gain of said response function at at least some other sound pressure levels.

* * * * *